United States Patent [19]

Conklin

[11] 4,059,832

[45] Nov. 22, 1977

[54] PORTABLE INTRUSION ALARM

[76] Inventor: LeRoy T. Conklin, 136 S. Ash, Blackfoot, Idaho 83401

[21] Appl. No.: 625,389

[22] Filed: Oct. 24, 1975

[51] Int. Cl.[2] ..... G08B 13/08

[52] U.S. Cl. ..... 340/274 R; 248/226.1; 340/283

[58] Field of Search ..... 340/283, 274 R, 276; 200/61.81, 61.93; 248/226 B, 226.1, 226.3

[56] References Cited

U.S. PATENT DOCUMENTS

| | | | |
|---|---|---|---|
| 3,261,010 | 7/1966 | Kardel | 340/283 |
| 3,270,333 | 8/1966 | La Barber | 340/283 X |
| 3,798,627 | 3/1974 | Kaufman | 340/283 X |
| 3,878,539 | 4/1975 | Gooding | 340/283 X |

*Primary Examiner*—Glen R. Swann, III
*Attorney, Agent, or Firm*—D. Paul Weaver

[57] ABSTRACT

A portable device for signaling the unauthorized movement of a closure member embodies an adjustable hanger bracket and an improved spring hinge construction which renders the device more sturdy, more reliable in operation and less expensive to manufacture. The alarm device also features a powerful buzzer powered by batteries in a unique holder.

1 Claim, 6 Drawing Figures

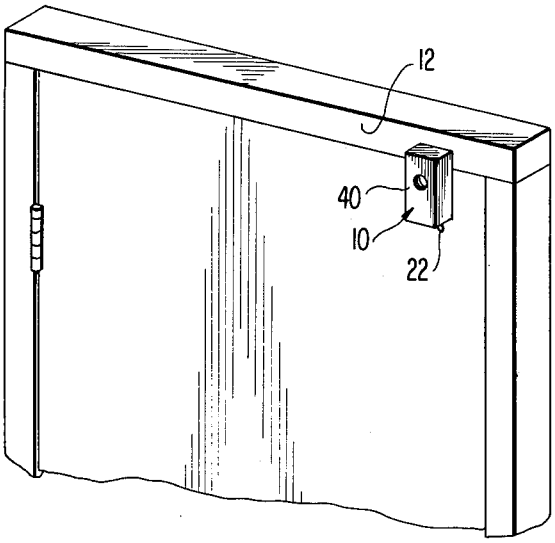
FIG. 1
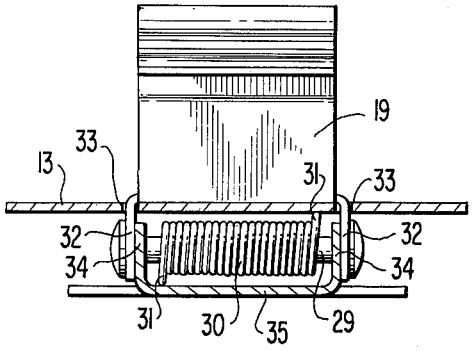
FIG. 4
FIG. 2
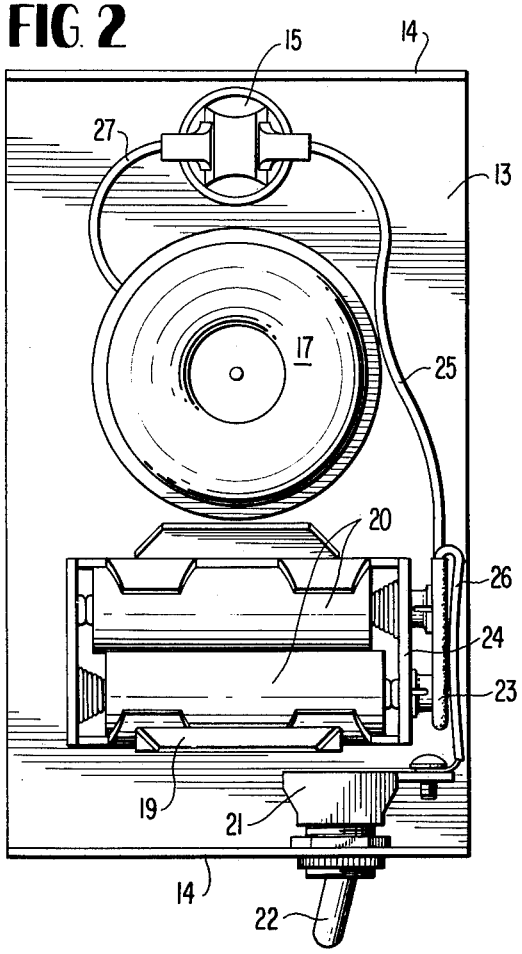
FIG. 3
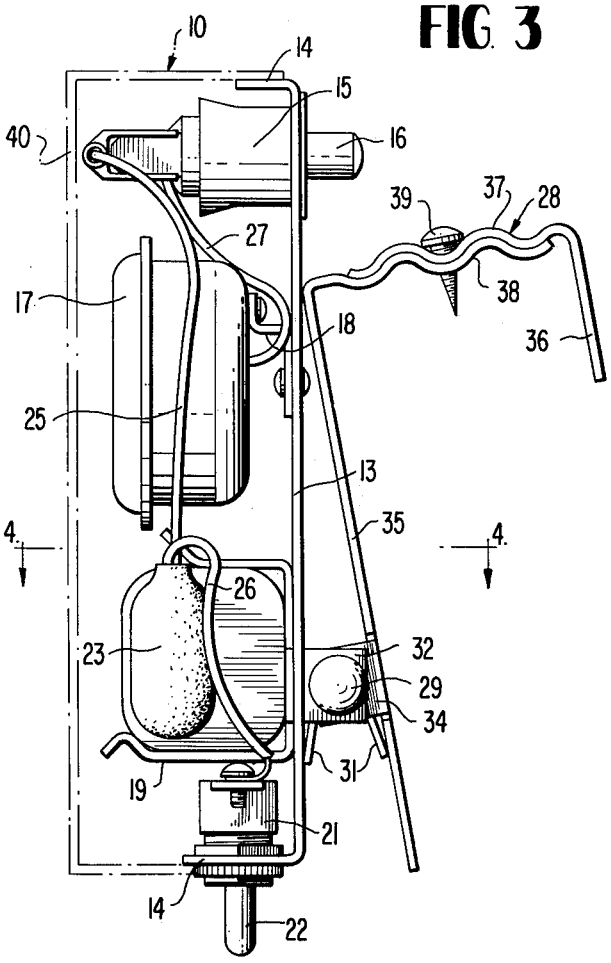

PORTABLE INTRUSION ALARM

BACKGROUND OF THE INVENTION

Portable alarms for movable closures, such as doors and windows, are known in the prior art and some examples of the patented prior art are shown in U.S. Pat. Nos. 3,270,333; 3,378,830 and 3,878,539.

The general objective of this invention is to improve on the prior art pertaining to intrusion alarms for doors and the like by the provision of a device which is more sturdy and economical in construction and more reliable in operation. More particularly, the invention features a more powerful buzzer of the six volt type powered by four one and one-half volt batteries contained in a sturdy holder attached to the base or mounting plate of the alarm device. Ears or extensions on the battery holder project through apertures in the mounting plate and cooperate with companion extensions carried by an adjustable mounting bracket through which the device is suspended from the top edge of a door. A strong torsion spring on the hinge pintle which connects the suspension bracket and mounting plate assures reliable biasing of the device toward a fixed abutment and reliable operation of the alarm when the door or other closure is moved by an intruder.

Other features and advantages of the invention will become apparent during the course of following description.

BRIEF DESCRIPTION OF DRAWING FIGURES

FIG. 1 is a fragmentary perspective view of a hinged door equipped with the intrusion alarm device according to the invention.

FIG. 2 is an enlarged front elevational view of the alarm device with the housing or cover removed.

FIG. 3 is a side elevational view of the device taken at right angles to FIG. 2.

FIG. 4 is a horizontal section taken on line 4—4 of FIG. 3.

DETAILED DESCRIPTION

Figure 6:
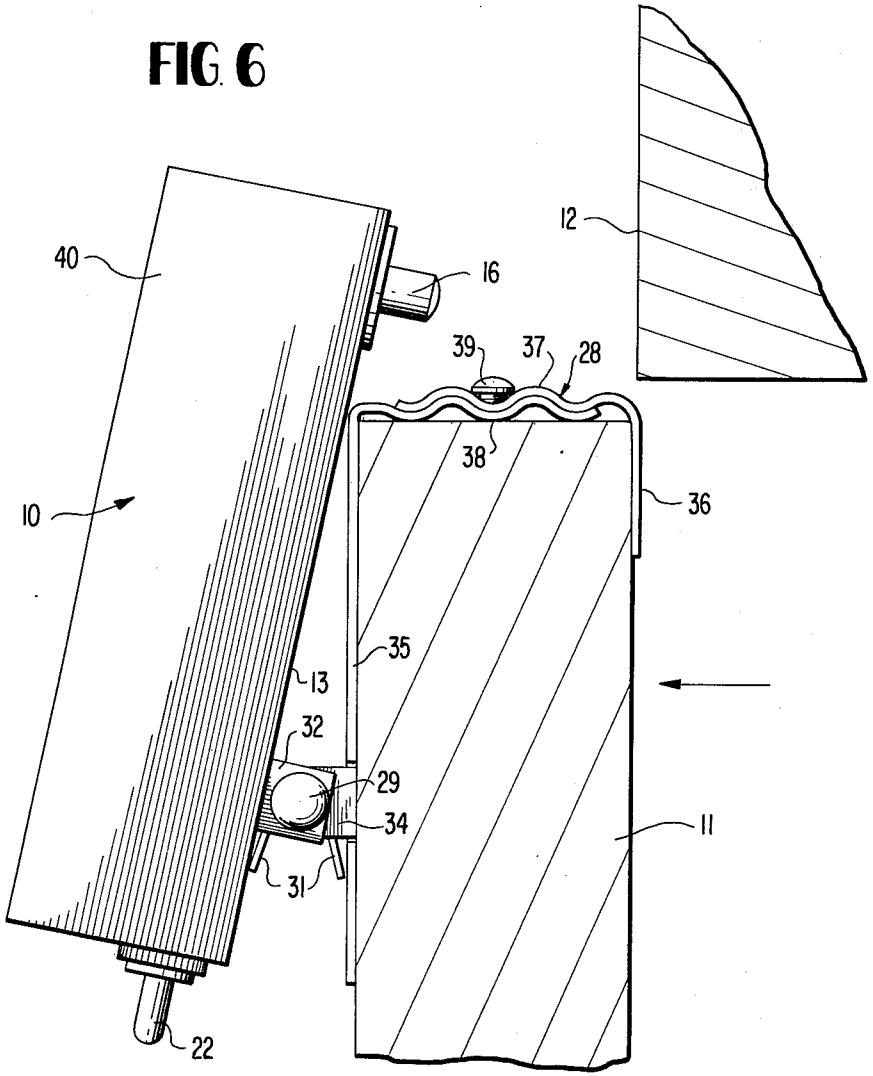
FIGS. 5 and 6 are additional side elevational views of the device with the cover or housing applied and illustrating its operation on a hinged door or other movable closure.

Referring to the drawings in detail wherein like numerals designate like parts, the numeral 10 designates a portable intrusion alarm for closures in its entirety, and illustrated as being applied to a door 11 in the drawings, such door being movable relative to a fixed frame member 12. It should be understood that the device is equally applicable to windows or other closures which move in relation to a fixed supporting structure.

The alarm device 10 comprises a sturdy mounting plate 13 having right angular end flanges 14 integral therewith. An alarm switch 15 is fixedly secured to the mounting plate 13 near one end thereof and near the flange 14 and has an axial push button 16 which is normally extended by a spring, not shown, to the position shown in FIGS. 3 and 6 in which the alarm switch is closed to complete the alarm circuit. When the push button or plunger 16 is depressed, FIG. 5, the alarm switch is opened for breaking the alarm circuit. As shown, the plunger or push button 16 projects rearwardly of the mounting plate 13 so as to be engageable with the stationary member 12, FIG. 5.

A six volt buzzer 17 is attached by a bracket 18 to the mounting plate 13 in a central position thereon. A generally U-shaped battery holder or clip 19 for four 1½ volt batteries 20 is attached by welding or the like to the mounting plate 13 near the end thereof remote from the alarm switch 15.

An on-off switch 21 having a toggle lever 22 is secured to the flange 14 near the battery holder 19, and the toggle lever projects downwardly from the device 10 for ready accessability when the device is suspended from the top edge of the door 11, as illustrated.

Figure 5:
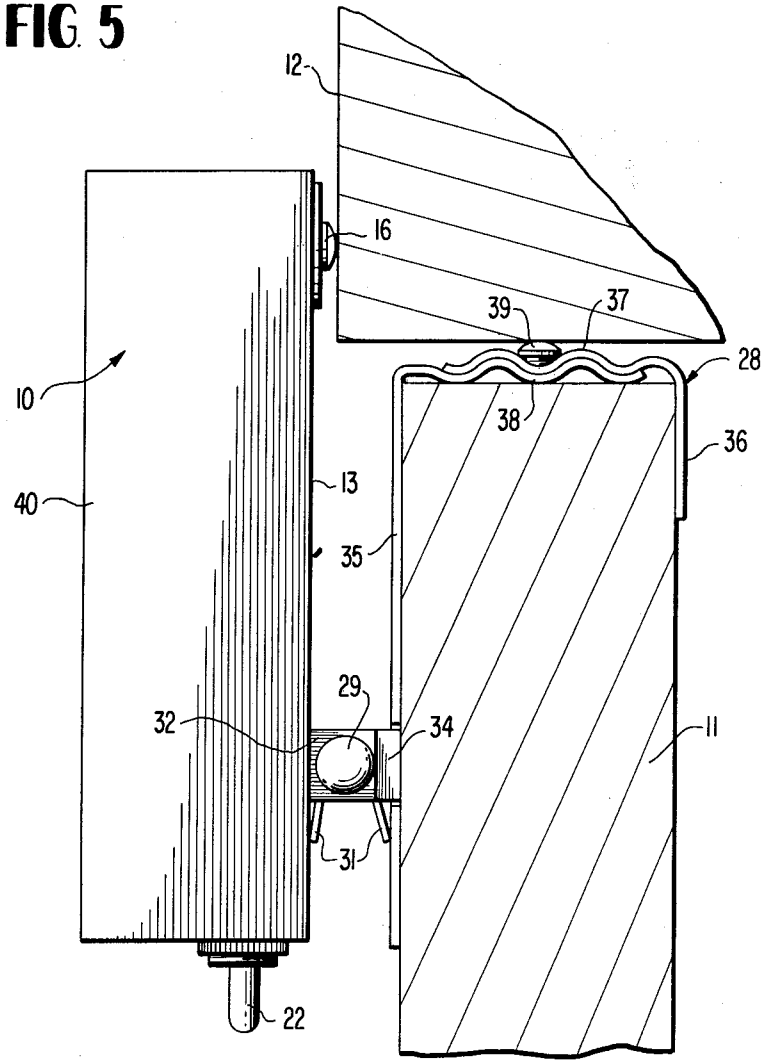

The electrical components 15, 17, 20 and 21 are series wired in the manner shown in FIG. 5 of the aforementioned U.S. Pat. No. 3,378,830 and therefore the wiring is entirely conventional. The wiring includes a plug connector 23 spanning a pair of battery terminals at one end wall 24 of the battery holder 19, FIG. 2. Wires 25 and 26 lead from the plug connector 23 to the alarm switch 15 and on-off switch, FIG. 2, and a wire 27 leads from alarm switch 15 to buzzer 17, as shown. The four one and one-half volt batteries 20 are connected within the holder 19 in a conventional manner so as to have a total power output of six volts.

A unique feature of the invention resides in the construction of a spring hinge connection between mounting plate 13 and a cooperating adjustable suspension bracket 28 for the alarm device. This spring hinge comprises a pintle 29 having a strong torsion spring 30 wrapped thereon including end extensions 31 which bear, respectively, against mounting plate 13 and the suspension bracket 28, FIG. 3. The spring hinge further comprises a first pair of rearwardly projecting ears or extensions 32 formed integral with opposite sides of the battery holder 19, FIG. 4, and extending rearwardly through slots 33 formed in mounting plate 13. A cooperating pair of ears 34 formed in the flat plate portion 35 of suspension bracket 28 have openings in registration with openings in the ears 32, and these openings receive the hinge pintle 29, FIG. 4, to complete the sturdy construction and the compact arrangement of the spring hinge.

The suspension bracket 28 is constantly biased by the spring hinge toward the mounting plate 13, FIG. 3, and when the device is unattached to a closure the bracket 28 will abut the mounting plate 13 at its corner remote from the pintle 29. This spring-biased arrangement of the elements 28 and 13 causes the plunger 16 to be depressed as in FIG. 5 when the device is installed on the door 11 and the door is closed in relation to the frame member 12. When the door is opened, FIG. 6, the plunger 16 in moving away from the member 12 is extended to close the alarm switch 15 and complete the alarm circuit through the buzzer 17, the switch 21 then being in the "on" position. At this time, the torsion spring 30 also biases the device 10 into engagement with the bracket 28, FIG. 6.

Bracket 28 is adjustable to accommodate closures of different thicknesses. More particularly, the hanger extension 36 of bracket 28 has corrugations 37 which interfit adjustably with corrugations 38 formed in the underlying portion of the bracket, generally at right angles to the plate portion 35. A suitable screw 39 serves to secure the hanger bracket in the selected width adjusted position.

A readily removable box-like cover or housing 40 for the device is provided and slips onto the flanges 14 and is attached to the mounting plate 13 in any suitable way for ready removal.

With the device 10 installed on the door 11 as described, and with the door closed, FIG. 5, and with the on-off switch 22 in the "on" or alarm circuit activating position, the normally closed alarm switch 15 will be held open by the push button or plunger 16 which is depressed by contact with the member 12.

If the door 11 is opened by an intruder, the plunger 16 will extend to the alarm circuit closing position as it moves away from the member 12 and the buzzer 17 will be activated by the circuit now established with the batteries 20. The alarm circuit is also de-activated when desired by shifting the toggle lever 22 to the "off" position of switch 21.

The device is simplified, very sturdy in construction, economical, adjustable and reliable in operation. It satisfies the need for a more practical portable intrusion alarm for doors and other closures than has heretofore been available.

It is to be understood that the form of the invention herewith shown and described is to be taken as a preferred example of the same and that various changes in the shape, size and arrangement of parts may be resorted to, without departing from the spirit of the invention or scope of the subjoined claims.

I claim:

1. A portable alarm device for closures comprising a mounting plate, an alarm switch, an on-off switch and an audible electrical alarm element secured to one side of the mounting plate, a battery holder on the same side of the mounting plate and having a pair of spaced ears formed integrally thereon, the mounting plate having spaced slots receiving said ears and the ears projecting beyond the other side of the mounting plate, said battery holder having a substantially U-shaped body portion including a flat base lying against the mounting plate and being fixed thereto, said spaced ears being directly attached to said flat face at opposite sides thereof and extending substantially at right angles to the flat face and said mounting plate, said alarm switch having an actuating plunger projecting beyond said other face of the mounting plate, a hanger bracket for said alarm device having a plate body extending near said mounting plate, said plate body having a pair of spaced ears formed integrally therewith and interfitting laterally with the ears of the battery holder, a pintle hingedly connecting the ears of the battery holder with the ears of the plate body, a coiled torsion spring surrounding the pintle between said ears of the battery holder and having ends bearing on the mounting plate and said plate body and biasing the mounting plate pivotally in one direction relative to said hanger bracket, and said hanger bracket including a substantially right angular extension which is transversely corrugated and said extension carried by the upper end of said plate body, and a coacting L-shaped corrugated hanger extension on the hanger bracket whose corrugations interfit adjustably with the corrugations of said extension, whereby the effective width of the hanger bracket may be varied to accommodate closures of different thicknesses, and separable threaded fastener means securing the interfitting corrugations in selected adjusted positions.

* * * * *